United States Patent [19]

Palm

[11] 4,050,405

[45] Sept. 27, 1977

[54] SINGLE-HOUSING MULTI-TRUMPET AIR HORN

[75] Inventor: Walter C. Palm, Grand Rapids, Mich.

[73] Assignee: Midland-Ross Corporation, Cleveland, Ohio

[21] Appl. No.: 671,593

[22] Filed: Mar. 29, 1976

[51] Int. Cl.[2] ..... G10K 9/04

[52] U.S. Cl. ..... 116/142 FP

[58] Field of Search ..... 116/142 FP, 142 R, 58, 116/24, 139, 137 R, 140; 46/177; 181/179

[56] References Cited

U.S. PATENT DOCUMENTS

| | | | |
|---|---|---|---|
| 1,898,536 | 2/1933 | Hewitt | 116/142 FP |
| 1,943,671 | 1/1934 | Hewitt et al. | 116/142 FP |
| 1,980,296 | 11/1934 | Scofield et al. | 116/140 |
| 2,477,427 | 7/1949 | Siegert | 116/142 R |
| 2,502,354 | 3/1950 | Swanson | 116/142 R |
| 2,944,509 | 7/1960 | Shintaku | 116/137 R X |
| 3,420,207 | 1/1969 | Holm | 116/142 R |

*Primary Examiner*—Daniel M. Yasich

*Attorney, Agent, or Firm*—Woodrow W. Portz

[57] ABSTRACT

Disclosed is an air horn comprising a housing and at least two amplifying trumpets attached thereto. Air may be fed from a single source into two sound-generating chambers with which the trumpets are connected by separate passageways to diaphragm-restricted openings of the chambers.

8 Claims, 11 Drawing Figures

SINGLE-HOUSING MULTI-TRUMPET AIR HORN

BACKGROUND OF THE INVENTION

Because of their greater sound emitting capability in view of cost, air horns are in common use on road vehicles carrying air pressure generating equipment, such as large trucks or highway tractors. Dual trumpet horns are preferred over one single trumpet horns because of their greater signal strength and more pleasant sound but have the disadvantage of being more complicated in structure then is now deemed necessary. As now usually constructed, the dual trumpet horn body is formed as a complicated die casting branched from an integral base bracket to form a pair of independent bodies providing separate air pressure sound-generating chambers which require two air-chamber caps, two sets of fasteners, extra gaskets, and separate air supply ducts.

A principle object of the invention is to construct a multiple trumpet horn, two or more trumpets according to a simpler, less expensive construction. Another object is to provide a single housing with a plurality of sound-generating chambers in accordance with the foregoing object with acceptable appearance features.

SUMMARY OF THE INVENTION

The invention is concerned essentially with providing a single housing containing the apparatus necessary for generating sound for two or more sound-amplification trumpets including an air-pressure chamber for each trumpet. The housing comprises a body and a cap which have mutually facing planate face surfaces along which the body and the cap are jointed and sealed from the atmosphere to completely form each of the chambers. The chambers are in laterally spaced relationship with the axes thereof extending generally parallel through both the body and the cap. In a preferred embodiment, the body defines portions of the chambers in the form of cavities spaced one from the other, extending inwardly from the body face surface, and being perimetrically defined by a continuous rabbet extending axially inwardly from the face surface and then laterally inwardly of the cavity toward the axis of the respective chamber to provide a narrow continuous perimetric seating surface for the edge margin of a diaphragm. The body also has longitudinally-angled air escape ducts which extend inwardly from their terminal ports in the outer surface of the body in lateral relation with axes of the chambers and inwardly to terminate inwardly of the cavities as a central annular boss in each cavity of substantially less outer diameter than any dimension of the surrounding seating surface extending transversely through the boss. The boss terminates in an annular diaphragm-engaging end surface extending within a plane which may be the same general plane of the seating surface or in closely adjacent parallel relation therewith. The air ducts are adapted as by internal threading within their outer terminal ports for connecting with a corresponding number of trumpets having, e.g., their proximal ends threaded for enabling them to be screwed into the threaded ports.

The cap has recesses which mate with the above described cavities to complete the air pressure chambers. When the body is rabbeted as described above, each recess of the cap is peripherally bounded by a contiguous ridge having a height beyond the face surface of the cap at least equal to the depth of the rabbet on the body which it enters and shaped to continuously engage the seating surface therein.

The horn further comprises diaphragms, i.e., a diaphragm for each chamber having a perimeter adapting it to continuously cover the seating surface of each cavity while engaging the corresponding boss end surface. Fastening means is provided for securing the cap to the body to effect the sealing of both chambers along the juncture of the cap ridge, the body seating surface opposite thereto, and the peripheral margin of the diaphragm received therebetween.

In a preferred embodiment, the rabbets of the cavities and the ridges fitting thereto have seating surfaces and end surfaces, respectively, which conform to a conical surface of revolution sloping toward respective axes inwardly of respective cavities whereby peripheral edges of diaphragms sandwiched therebetween are forced into conformity to effect a resilient pressure engagement of the diaphragm on the end surfaces of the bosses in respective cavities. Such construction augments the pressure normally supplied by a spring supported in compressed condition between the cap and the diaphragm in effecting pressure of the diaphragm on the adjacent engaging boss.

BRIEF DESCRIPTION OF THE DRAWING

In the drawing with respect to which the invention is described.

BRIEF DESCRIPTION OF THE EMBODIMENTS

Figures 1, 2, 3, 4, 5, 6:
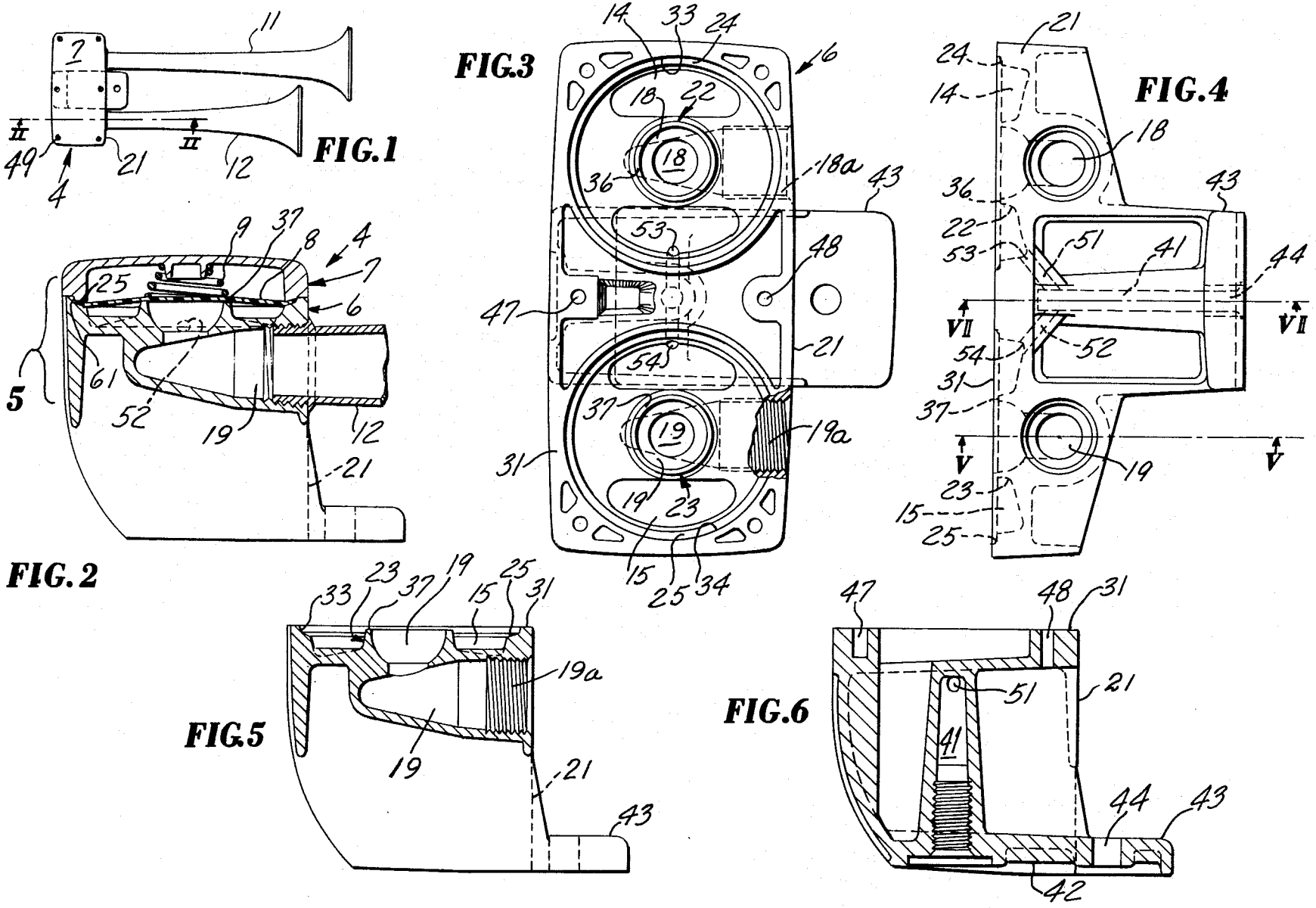
FIG. 1 is a plan view of a dual trumpet horn described herein.
FIG. 2 is an assembly view in section taken along line II—II of FIG. 1.
FIG. 3 is a plan view of the body of the horn of FIGS. 1 and 2 with cavities thereof exposed.
FIG. 4 is a front view of the horn body as shown in FIG. 3.
FIG. 5 is a section view of the horn body of FIGS. 3 and 4 taken along line V—V of FIG. 4.
FIG. 6 is a vertical section view of the horn body of FIGS. 3 and 4 taken along a central vertical plane or line VI—VI of FIG. 4.

FIGS. 1 and 2 illustrate a dual trumpet horn 4 having a housing 5 comprising a body 6, and a cap 7. Internally of the housing, the horn further comprises a pair of diaphragms 8 of which one is shown in FIG. 2, a pair of springs 9, such as the one shown in FIG. 2. Externally, the horn has trumpets 11 and 12 shown in FIG. 1.

Figure 8:
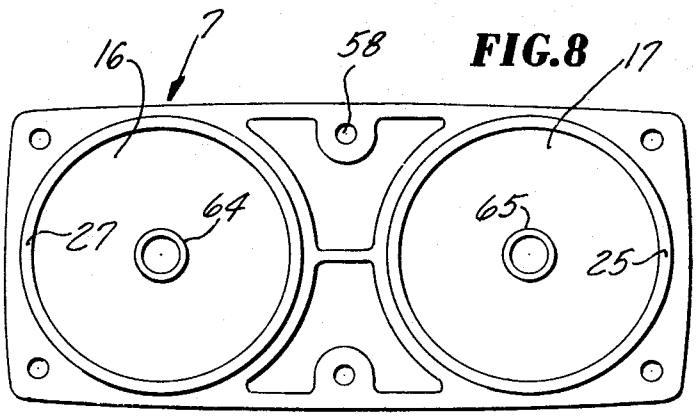
FIG. 8 is an underside plane view of the cap shown in FIG. 7.

The housing 5, i.e., the body 6 and the cap 7, define a pair of air pressure chambers of which the portions thereof in the body are cavities 14,15, and the portions in the cap 7 are recesses 16,17 (see FIG. 8). The body 6 defines air escape ducts 18,19 which extend inwardly from outer surface 21 of the body in lateral relation with the axes of the chambers, and terminate centrally inwardly of the respective cavities 14,15 within corresponding bosses 22,23. The ducts 18,19 are longitudinally-angled, i.e., they have threaded portions 18*a* and 19*a* opening in lateral surface 21 aligned at substantially right angles with portions thereof within the bosses 22,23, respectively, to align the trumpets 11,12 in corresponding angled relation with the axes of cavities 16,17 connected therewith. Each boss is of substantially less outer diameter than any transverse dimension of the cavity extending through the boss, e.g., the inner diameters of annular seating surfaces 24,25 for annular ridges 27,28 of the cap 7. As shown by FIGS. 3 and 5, each cavity is formed adjacent to face surface 31 of the body as a rabbet extending first axially inwardly of its respective cavity to form a side surface 33 or 34 of the rabbet and then laterally inwardly of the cavity toward the axis thereof to form either of the seating surfaces 24 or 25 at the bottom of the rabbet.

As shown in various elevation views, the seating surfaces 24,25 of body 6 occur at greater depths below the face surface 31 than the diaphragm-engaging end surfaces 36,37 of the bosses 22,23, respectively. This arrangement of the body seating surfaces and end surfaces of body bosses enables the cap ridges to resiliently deflect normally planate diaphragms 8, as shown in FIG. 2, when the horn is assembled. Also, FIGS. 4 and 5 are such that seating surfaces 24 and 25 are frusto-conical and extend within frusto-conical surfaces of revolution sloping inwardly of respective cavities toward respective axes. The angle of the slope of these surfaces of revolution with respect to diametral planes of the seating surfaces or planes perpendicular to the respective axes of the cavities is preferably about 7°. Face surface 31, the end surfaces of the bosses, and any plane taken through any selected circumference of the seating surfaces are preferably parallel. As shown, the end surfaces and the seating surfaces are circular and concentric. It is possible for the seating surfaces and corresponding cap ridges to be formed to mating polygonal configurations extending concentrically or symetrically about the bosses.

The cavity dimensions of the body are so proportioned as to cause the plane of the diaphragm-engaging end surface of either boss to be spaced toward the cap from a plane containing the inner circumference of the respective conical seating surfaces 24 or 25. The spacing of these planes causes a conical surface of revolution containing both the end surface of the boss and the inner diameter of the seating surface concentric thereto extend at an angle in the approximate range of 2.5° to 3° with these parallel planes. Typically, this relationship results when the inner diameter of the conical seating surface is about 2¼inches, the outer diameter of the boss end surface is about 1 inch, and the spacing between the planes of the boss end surface and the inner diameter of the seating surface is about 0.03 of an inch. Other typical dimensions in the practice of the invention call for the plane of the boss end surface being about 0.03 of an inch inward of the cavity from the plane of the body face surface 31, the inner diameter of the boss adjacent its end surface being about ⅞ of an inch, and the radial width of the seating surfaces 24, 25 is about 1/10 of an inch. Preferably, the rabbet side surfaces 33,34 have a slight inwardly tapering conicity.

A section taken along a center vertical plane between the two cavities 14,15 in accordance with FIG. 6 shows a threaded bore 41 extending from an undersurface 42 of the body upwardly through a major portion of the height of the body. A bracket 43 formed by a horizontal extension of the lower wall of the body provides a fastener opening 44 by which the horn may be secured to a truck cab roof or other base by a bolt or other fasteners. FIG. 6 also illustrates threaded holes 47,48 for receiving cap screws used for fastening the cap 7 to the body 6. FIG. 6 also shows that the bracket stands sufficiently beyond the front face 21 of the horn body to dispose the opening 44 forwardly of the plane of face 21.

The bore 41 is, in fact, a supply duct for air having branch ducts 51,52 terminating in cavities 14 and 15 as apertures 53 and 54, respectively. The bore 41 is threaded inwardly from the undersurface 42 for receiving an exteriorly threaded air-supply fitting (not shown) which may also be used for fastening the horn to any selected base in addition to a fastener located in opening 44. Air is supplied to the bore 41 by a conventional air supply system, such as disclosed in U.S. Pat. No. 2,281,539. At sufficient pressure, air passes in a known manner between the diaphragms respective adjacent end surfaces of bosses 22,23 during diaphragm vibrations and outwardly through air escape ducts 18,19.

Figure 7:
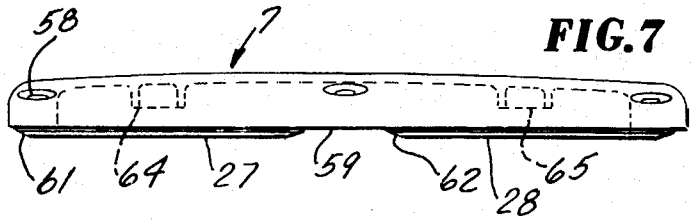
FIG. 7 is a front elevation of a cap shown in FIGS. 1 and 2 for the body shown in FIGS. 3 to 5.

FIGS. 7 and 8 are side elevation and bottom plan views, respectively, of the cap 7 normally attached to the body 6 by cap screws 49 extending through holes 58 into threaded holes of the body. The diametral extremities of recesses 16 and 17 are defined by ridges 27,28 which extend axially outwardly beyond the face surface 59 a distance equal to or greater than the depth of the seating surface of the body. The seat-engaging undersurfaces 61,62 are frusto-conical and conform to the same surfaces of revolution as the seating surfaces 24,25. Means for centering the springs 9 in concentric relation with the bosses may be provided as shown in FIG. 8 through provision of annular bosses 64,65 of the cap which extend internally of the springs in operative positions.

With the horn housing 5, the springs 9, the diaphragms 8 assembled as shown in FIG. 2, the cap presses the marginal edges of the diaphragm 8 into conformity with respective mating ridge and rabbet surfaces of the cap and body, respectively. That is to say, the angle of the surfaces with respect to a diametral plane through the horn chamber places the diaphragm in a condition of resilient deformation wherein a concentric portion of the diaphragm is subjected to a bending moment tending to increase the pressure of a center portion on the circular boss surface 36 or 37. This pressure is augmented in either case by a spring 9 in a state of compression between the interior surface of the cap and the diaphragm 8.

SECOND EMBODIMENT

Figure 10:
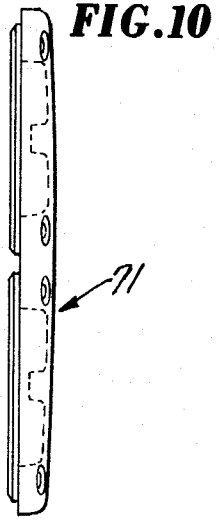
FIG. 10 is a side elevation view of a cap for a modified horn having a body as shown in FIG. 9.
Figure 9:
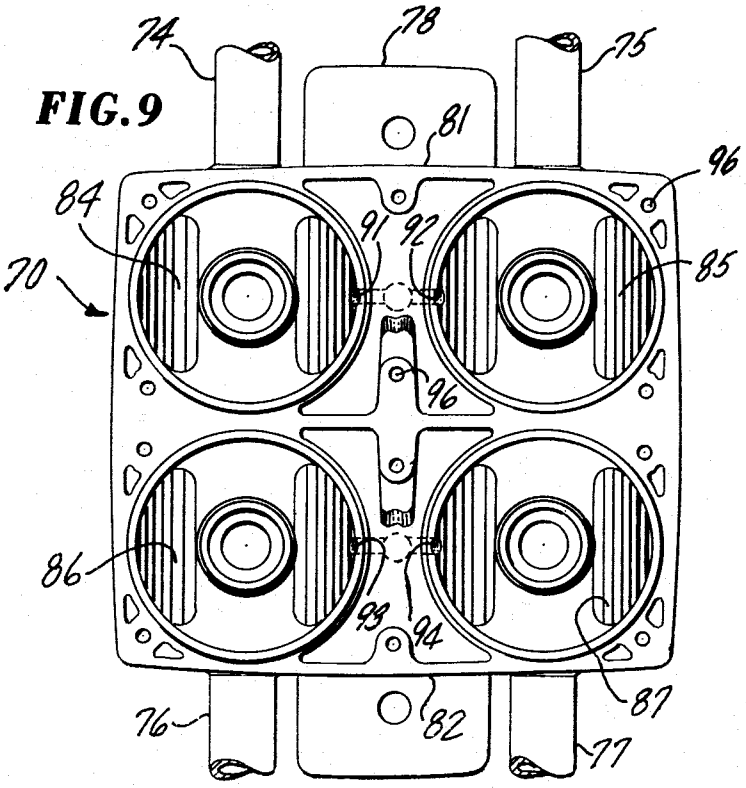
FIG. 9 is a top plan view of the body of a four trumpet horn.
Figure 11:
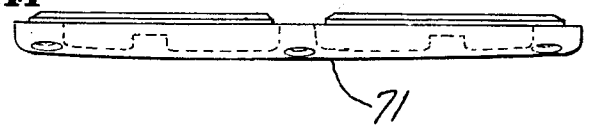
FIG. 11 is a front end elevation of the cap shown in FIG. 9.

FIGS. 9, 10, and 11 illustrate components of a four trumpet horn of which the body 70 (FIG. 9) and the cap 71 (FIGS. 10 and 11) define four air pressure chambers within which diaphragm vibration generated by passage of air between the diaphragms and adjacent cavity bosses generate a signal which may be in four tones when the lengths of the trumpets 74,75,76 and 77 are varied. The bodies constructed with a bracket 78 which extends centrally under the chambers and projects beyond opposite sides 81,82 in a manner already described with respect to the first embodiment. Air is supplied to cavities 84,85,86,87 through air duct manifolding providing outlet parts 91,92,93 and 94 from a common air supply. Air is supplied to the horn in a conventional manner, not shown, such as by supply means including a solenoid valve as described in U.S. Pat. No. 2,281,539 or by a supply line containing a conventional manual lanyard valve. The cap 71 in combination with a set of four springs 9 and four diaphragms 8 is secured to the body by cap screws extending through the cap 71 into threaded relation with the body at holes 96 in a manner similar to that already described with respect to the first embodiment. The resulting horn is useful for factory and marine installations where high signal strengths are required. The embodiment of FIGS. 9 to 11 is exemplary and suggestive of other arrangements of pressure chambers and trumpet outlets in greater or lesser number.

What is claimed is:

1. A multiple-trumpet air horn comprising:

a housing comprising a body and a cap defining a plurality of laterally spaced air pressure chambers, each centered with respect to an axis in parallel relation with the axes of the other chambers and extending generally perpendicularly to mutually-facing planate face surfaces of the cap and the body;

a diaphragm for each chamber adapted to be peripherally confined between said body and said cap;

said body defining portions of said chambers in the form of a cavity for each chamber spaced one from the other, each cavity extending inwardly from said face surface of the body and being perimetrically defined by a continuous rabbet extending axially inwardly from said face surface and then laterally inwardly of the cavity toward the axis thereof to provide a narrow continuous perimetric seating surface;

said body defining longitudinally-angled air escape ducts, each of which extends inwardly from an outer lateral surface of the body and terminates centrally inwardly of said cavity in a portion formed by an annular boss of substantially less diameter than any transverse dimension of the respective encircling seating surface extending through said boss, said boss terminating in an annular diaphragm-engaging end surface extending within a plane and parallel adjacent relation to, or within, the general plane of said seating surface, said air ducts terminating at said outer surface in substantially right angle relation with the portions thereof formed by said bosses in means for connecting the body with a pair of horn trumpets;

said cap defining portions of said chambers as a corresponding plurality of recesses having perimeters generally matching those of said cavities when the cap is operatively positioned on said body, each of said recesses being peripherally bounded by a continuous ridge of a height beyond said face surface of the cap at least equal to the depth of the rabbet of the respective opposed cavity, said ridge being shaped complementary to said seating surface of the rabbet for continuously engaging the entire peripheral edge of one of said diaphragms confined therebetween, each of said diaphragms being thereby confined in central engagement with one of said bosses in a condition of resilient deformation;

duct means extending within said body from an exterior surface to portions of each cavity radially outwardly of said boss therein for supplying air to the cavities; and fastening means for securing said cap to the body to affect sealing of all chambers along junctures of the diaphragms, cap ridges, and body seating surfaces of said chambers.

2. The double-trumpet air horn of claim 1 comprising:

a spring in each cap recess positioned in a state of compression between said cap and the portion of the diaphragm of said diaphragms overlying the corresponding boss end surface of said end surfaces;

said cap comprising centering means engaging said spring to maintain it in alignment with said end surface.

3. A double-trumpet air horn comprising:

a housing comprising a body and a cap defining two laterally spaced air pressure chambers, each centered with respect to one of two generally parallel axes extending generally perpendicularly to mutually-facing planate face surfaces of the cap and body;

a diaphragm for each chamber adapted to be peripherally confined between said body and said cap;

said body defining portions of both chambers in the form of two cavities spaced one from the other, each cavity extending inwardly from said face surface of the body and being perimetrically defined by a continuous rabbet axially inwardly from said face surface and then laterally inwardly of the cavity toward said axis to provide a narrow continuous perimetric seating surface;

said body defining longitudinally-angled air escape ducts which extend inwardly from an outer lateral surface of the body and terminate centrally inwardly of said cavities in portions formed by annular bosses, each boss being of substantially less diameter than any transverse dimension of the respective said seating surface extending through said boss, said boss terminating in an annular diaphragm-engaging surface entending within a plane in parallel adjacent relation to, or within, the general plane of said seating surface, said air ducts terminating at said outer surface in substantially right angle relation with the portions formed by said bosses in means for connecting the body with a pair of horn trumpets;

said cap defining portions of said chambers as two recesses having perimeters generally matching those of said cavities when the cap is operatively on said body, each of said recesses being peripherally bounded by a continuous ridge of height beyond said face surface of the cap at least equal to the depth of the rabbet of the respective opposed cavity, said ridge being shaped complementary to said seating surface of said rabbet for continuously engaging the entire peripheral edge of one of said diaphragms confined therebetween, each of said diaphragms being thereby confined in central engagement with one of said bosses in a condition of resilient deformation;

duct means extending within said body from an exterior surface to portions of each cavity radially outwardly of said boss therein for supplying air to the cavities; and fastening means for securing the cap to the body of effect sealing of both chambers along the junctures of the diaphragms, cap ridges, and body seating surfaces of said chamber.

4. The double-trumpet air horn of claim 3 wherein:

said surface for terminating said air ducts extends generally along a reference plane parallel to a plane containing said two axes; and said body comprises a lower bracket portion having a flat undersurface extending in transverse relation to said plane of said axes and centered between said axes and extending through said reference plane to provide means beyond said reference plane for fastening said horn to a base.

5. The double-trumpet air horn of claim 3 wherein:

said seating surfaces and respective ridge end surfaces are conical according to frusto-conical surfaces of revolution sloping inwardly of respective cavities toward respective axes.

6. The double-trumpet air horn of claim 5 wherein:

the slope of said surface of revolution relative to a plane normal to said axes is about 7°.

7. The double-trumpet air horn of claim 5 wherein:

the plane of the diaphragm-engaging end surface of the boss is spaced toward said cap from a plane containing the inner circumference of said conical seating surface, and a conical surface of revolution containing said end surface and said inner diameter extends at an angle in the approximate range of 2.5° to 3° with said planes.

8. The double-trumpet air horn of claim 7 wherein:

said end surfaces of the bosses are located along a plane between that of the body face surface and said plane containing said inner diameters.

* * * * *

UNITED STATES PATENT AND TRADEMARK OFFICE

CERTIFICATE OF CORRECTION

PATENT NO. : 4,050,405

DATED : September 27, 1977

INVENTOR(S) : Walter C. Palm

It is certified that error appears in the above-identified patent and that said Letters Patent are hereby corrected as shown below:

Column 3, line 27, delete "are such" and insert --show--.

Column 4, line 31, "surface" should be --surfaces--.

Column 6, claim 3, line 24, insert --extending-- between "rabbet" and "axially". Line 45, insert --positioned-- between "operatively" and "on". Line 61, "of" should be --to--. Claim 4, line 66, insert --outer-- between "said" (first occurrence) and "surface".

Column 8, claim 6, line 1, "surface" should be --surfaces--.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*